US005871210A

United States Patent [19]

Harrison

[11] Patent Number: 5,871,210

[45] Date of Patent: Feb. 16, 1999

[54] CROSSWORD PUZZLE GAME

[76] Inventor: James Frank Harrison, 343 Lorne Street, Port Perry, Ontario, Canada, L9L 1G1

[21] Appl. No.: 807,467

[22] Filed: Feb. 27, 1997

[51] Int. Cl.[6] ..... A63F 9/18

[52] U.S. Cl. ..... 273/148 R; 273/272

[58] Field of Search ..... 273/272, 269, 273/148 R

[56] References Cited

U.S. PATENT DOCUMENTS

| | | | |
|---|---|---|---|
| 4,106,773 | 8/1978 | Coefield | 273/272 X |
| 4,209,173 | 6/1980 | Curtis et al. | 273/272 X |
| 4,850,595 | 7/1989 | Sherman et al. | 273/272 X |
| 4,907,807 | 3/1990 | Lee et al. | 273/272 X |
| 4,941,668 | 7/1990 | Mobrem | 273/272 X |

*Primary Examiner*—Raleigh W. Chiu
*Attorney, Agent, or Firm*—Banner & Witcoff, Ltd.

[57] ABSTRACT

The structure has a panel provided with a number of openings arranged in parallel rows and columns. Each opening may be opened and closed by a flap. A corner of each flap is removed so that a part of each opening remains open when the flap is closed. A completed crossword puzzle is held stationary beneath the upper panel. Each square of the puzzle displays either a letter or a blank. The square also displays in one of its corners an indication of what the remainder of the square displays whether a letter or a blank. Each square is visible through a respective opening when the flap which is closed by the opening is open and when the flap is closed the letter or blank within the square is hidden but the indication within the square is visible through the open part of the opening.

10 Claims, 2 Drawing Sheets

CROSSWORD PUZZLE GAME

BACKGROUND OF THE INVENTION

This invention relates to a crossword puzzle game and more particularly to a competitive crossword puzzle game which is played by two or more players.

Crossword puzzles may be played by one or more players and if there is more than one, they usually cooperate with each other in solving the puzzles. Seldom do the players compete with each other. Recently however games have been devised for the playing of crossword puzzles competitively. Examples of such games are described in U.S. Pat. Nos. 4,106,773 to Coefield and No. 4,850,595 to Sherman et al.

Known games intended for competitive play have a number of shortcomings. Some such as the puzzle described in Sherman et al. introduce the element of chance into the game. Many players of crossword puzzles consider, however, that chance is not an appropriate element in a game whose primary object is to challenge the players' intellect. Others such as the puzzle described in Coefield display a crossword puzzle in blank and the players take turns in filling in the puzzle. If a word is challenged it is verified by reference to the completed puzzle. The player who verifies the word may, in looking at the word in question, inadvertently look at other words as well. If he does of course there is little point in continuing to play.

The game of crossword puzzle of the present invention obviates many of the shortcomings of known games. For example, chance plays little part in the playing of the game. As well only one word at a time is uncovered as the game is played. That word is the one being sought and no other so that the possibility of the players inadvertently seeing other words is minimized.

SUMMARY OF THE INVENTION

The game of the invention may be broadly described as a structure for players to compete in completing a crossword puzzle including: a lower panel; an upper panel mounted upon the lower panel and having a plurality of openings arranged in parallel rows and columns; a flap for opening and closing all except for a part of each opening such that the part remains open when the flap is closed; a completed crossword puzzle made up of a surface on which appears a grid of lines which define squares arranged in parallel rows and columns, each square displaying either a letter or a blank and further displaying, in one corner thereof, an indication of what the square displays whether a letter or a blank, the puzzle being removably received in the space between the lower and upper panels; and means for holding the puzzle stationary in the space in such a way that each square is visible through a respective opening when the flap which is closed by the opening is open and when the latter flap is closed the letter or blank within the square is hidden but the indication within the square is visible through the open part of the opening.

DESCRIPTION OF THE DRAWINGS

The structure of the game of crossword puzzle according to the invention is described with reference to the accompanying drawings in which.

Like reference characters refer to like part throughout the description.

DESCRIPTION OF THE PREFERRED EMBODIMENT

Figures 1, 2, 3:
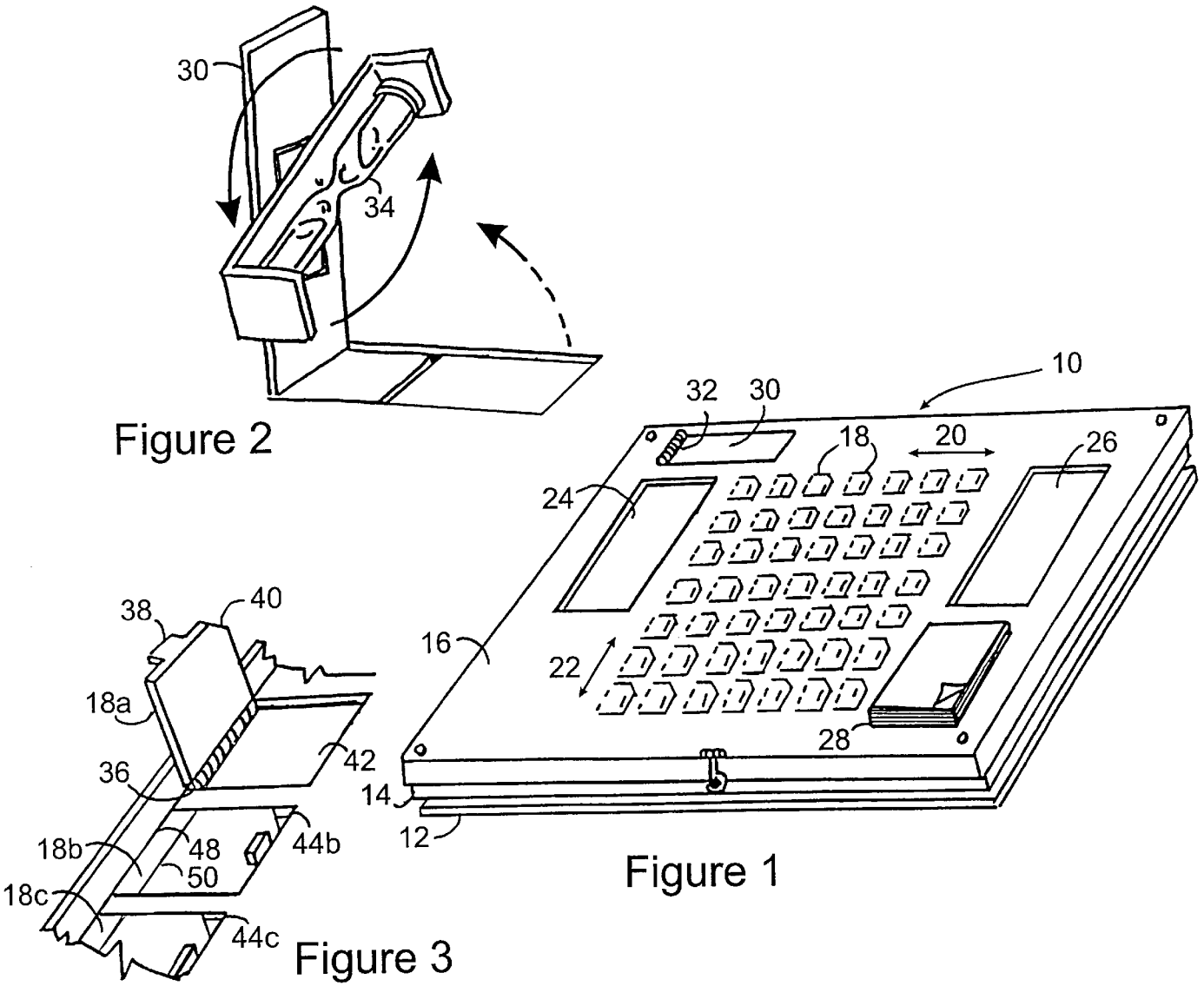
FIG. 1 is a perspective view of the structure.
FIG. 2 is a perspective view of a timer, in enlarged scale.
FIG. 3 is a fragmentary perspective view of the flaps on the upper surface of the structure, in enlarged scale.

With reference to FIG. 1 the structure of the game according to the invention, generally 10, has a base 12, a lower panel 14 and an upper panel 16. Flaps 18 are formed on the upper panel and are arranged in a grid of parallel rows indicated by arrow 20 and columns indicated by arrow 22. A pair of windows 24, 26 is also formed in the upper panel and a scratch pad 28 and a hatch 30 are provided on the panel.

With reference to FIG. 1 and 2, hatch 30 is attached to the upper panel by means of a hinge 32 so that the hatch may be opened to the position illustrated in FIG. 2 from the closed position illustrated in FIG. 1. An hourglass 34 is mounted for rotation to the lower surface of the hatch.

With reference to FIG. 3, flap 18a is attached to the upper surface by hinge 36. The flap is provided with an upwardly extending tab 38 to facilitate manual opening and closing of the flap. The flap is rectangular except for one corner 40 which is removed.

The flap serves to open and close a rectangular opening 42 formed in the upper panel. When the flap is closed it serves to close all except for a part of the opening. That part is indicated 44*b,c* in flaps 18*b,c*.

A bar 48 is affixed to the upper panel and extends adjacent to the flaps in each column. The bar is magnetized and attracts a metallic plate 50 attached to the upper surface of each flap. The bar holds each flap normal to the plane of the upper wall of panel 16 when the flap contacts it. A like bar (not illustrated) is provided adjacent to hatch 30 to hold it open.

Figure 4:
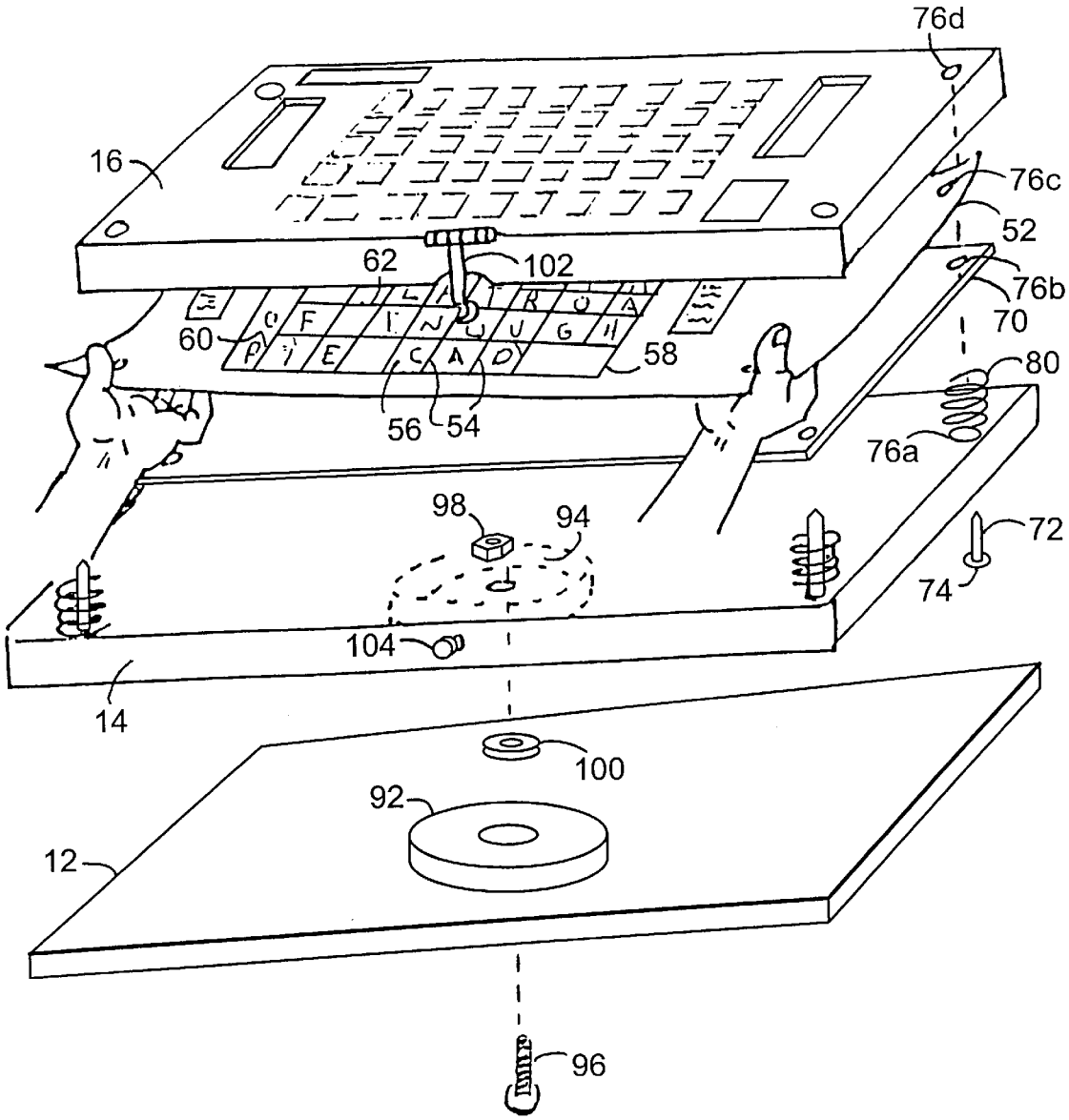
FIG. 4 is an exploded perspective view of the structure of the game.

With reference to FIG. 4, a sheet 52 of paper or plastic is disposed immediately below the upper panel 16. A completed crossword puzzle is formed on the sheet. As is conventional, the puzzle is made up of a grid of lines 54 which define squares arranged in parallel rows and columns. Each square displays either a letter, such as at 56, or a blank, such as at 58.

The squares are numbered consecutively and the numbers appear in one corner of each square. There is also in that corner an indication of what appears on that square. Corner 60 for example is white and indicates that a letter appears in that square. Corner 62 by contrast is black and indicates that the square is blank. There may be other indications of what appears in the squares. For example, colours other than black and white and marks such as crosses or circles are suitable indications.

Disposed beneath sheet 52 is a backing plate 70 for holding the sheet flat. Lower panel 14 is disposed beneath the backing plate. The lower and upper plates, sheet and backing plate are held together by means of a guide post 72 adjacent to the four corners of each.

Each post has a head 74 which abuts the lower surface of the lower panel and a shank that passes through apertures 76*a,b,c,d* in the lower panel, backing plate, sheet 52 and the upper panel respectively. The apertures 76 are formed such that their axes are in alignment when the upper and lower panels, sheet and backing plate are in the desired positions relative to each other. When the guide posts are in the apertures they will hold these components in such positions.

The lower portion of each guide post is threaded as is the wall of each aperture 76*a* formed in the lower panel so that the posts are affixed to the lower panel.

A coil spring 80 encircles each guide post in the space between the lower panel and the backing plate. The springs serve to bias the backing plate upwardly so that sheet 52 is pressed into contact with the upper panel. The backing plate, upper panel and coil springs cooperate to ensure that the sheet is flat beneath the upper panel and they, together with guide posts 72, are the means by which the sheet remains stationary.

When the upper panel is removed sheet 52 can be removed and replaced by another sheet having a different crossword puzzle. Normally there will be a stack of sheets on the guide posts so that removal of the uppermost sheet will expose the sheet beneath it.

The crossword puzzle is arranged on the sheet in such a way that each square is beneath a separate opening 42 in the upper panel. Thus when the flaps are open all the letters and blanks which make up the puzzle are fully displayed. When the flaps are closed only the part of each square beneath the open corners 40 of the flaps is visible. That part of each square displays the number of the square and the indication of what the remainder of the square displays. Thus when the flaps are closed, the numbers and indications are all visible from above the upper panel.

A circular journal 92 is mounted to the top wall of base 12 and the journal is received in a bearing 94 formed in the lower panel. The journal is held in the bearing by means of a bolt and nut 96, 98 and a washer 100 is interposed between the journal and the lower panel.

A latch 102 on the edge of the upper panel cooperates with a pin 104 on the lower panel to interconnect the two panels.

The game is prepared for playing as follows: The upper panel is unlatched from the lower panel and the upper panel is removed from the guide posts. The guide posts are then inserted through the apertures of a stack of sheets of crossword puzzles and the sheets are placed so that they lie flat on the backing plate. The upper panel is then replaced on the guide posts and all its flaps are closed.

The uppermost sheet will then lie such that each of the squares of its crossword puzzle is beneath a separate opening. All but a corner of the squares will be hidden by the flaps. Those corners display the number of the squares and the indications of what the squares display.

All flaps should then be opened where the squares beneath them are blank. The magnetic bar behind each flap ensures that the flaps remain fully open while the puzzle is being worked on.

The definitions or clues to the horizontal words displayed on the puzzle are displayed through window 24 and the definitions or clues to the vertical words through window 26. A number is set out beside each definition or clue and that number indicates the value of the word.

The game is placed on a table and the players of the game who must number at least two sit at the table. The players in turn decide what definition or clue they will choose. Each player in turn will say out loud or write down the word on the puzzle which he believes is the answer to the definition or clue. The timer is provided for limiting the amount of time that the player has to consider his answer.

When the player has given his answer, the other player or players have an opportunity to challenge the answer. The flaps which conceal the word on the puzzle are then opened. The squares may be coloured and different values assigned to each colour.

When it is the next player's turn, the upper portion of the structure is swivelled about base 12 until the player can read the words in the upper panel and the player then chooses a clue or definition that he wishes to solve.

Points are accumulated or lost as follows: If the word is correct then the value of that word is awarded to the player together with the value of each letter of the word indicated by the colour of the squares on which the word appears. If the word is incorrect the value of that word is subtracted from the player's score.

If the word is incorrect and the word was challenged before the word was displayed the value of the word is assigned to the challenger and if the word is correct the player is awarded the points for it and the challenger loses the same number of points.

If player takes too long to answer he loses a turn.

Numerous variations on the above rules are of course possible. For example part points can be awarded for a word which is correctly pronounced but incorrectly spelled. The number of part points can depend on where the misspelling occurs. There can be bonus letters which can double or triple the score of a word containing them.

It will be understood of course that modifications can be made in the preferred embodiment illustrated and described herein without departing from the scope and purview of the invention as defined in the appended claims.

The embodiments of the invention in which an exclusive property or privilege is claimed are defined as follows:

1. Structure for players to compete in completing a crossword puzzle including: a lower panel; an upper panel mounted upon said lower panel and having a plurality of openings arranged in parallel rows and columns; a flap for opening and closing all except for a part of each said opening such that the part remains open when said flap is closed; a completed crossword puzzle made up of a surface on which appears a grid of lines which define squares arranged in parallel rows and columns, each said square displaying either a letter or a blank and further displaying, in one corner thereof, an indication of what said square displays whether a letter or a blank, said puzzle being removably received in the space between said lower and upper panels; and means for holding said puzzle stationary in said space in such a way that each said square is visible through a respective said opening when the flap which is closed by said opening is open and when the latter said flap is closed the letter or blank within said square is hidden but the indication within said square is visible through the open part of the opening.

2. The structure as claimed in claim 1 further including: a bar mounted on said upper panel adjacent to each said flap, said bar being so arranged as to contact said flap when said flap is disposed normal to the plane of the upper panel; and magnetic means for affixing said flap to said bar when said flap and said bar are in contact with each other.

3. The structure as claimed in claim 2 wherein said upper panel has at least one window and said puzzle displays a plurality of definitions or clues for solving the puzzle, said definitions or clues appearing through said window when said puzzle is maintained stationary by said holding means.

4. The structure as claimed in claim 2 further including a base to which said lower panel is mounted for rotation.

5. The structure as claimed in claim 1 wherein said upper panel has at least one window and said puzzle displays a plurality of definitions or clues for solving the puzzle, said definitions or clues appearing through said window when said puzzle is maintained stationary by said holding means.

6. The structure as claimed in claim 1 further including a timer.

7. The structure as claimed in claim 6 wherein said times is an hour glass and said structure further includes a hatch hinged to the upper panel and pivotal from a closed position in which its upper wall is flush with the upper wall of the upper panel to an open position in which the hatch is normal to said upper wall, said hour glass being rotatably mounted to a lower wall of the hatch and a bar mounted on said upper panel adjacent to said hatch, said bar being so arranged as to contact said hatch when said hatch is in an open position; and magnetic means for affixing said hatch to said bar when said hatch and said bar are in contact with each other.

8. The structure as claimed in claim 7 further including a base to which said lower panel is mounted for rotation.

9. The structure as claimed in claim 6 further including a base to which said lower panel is mounted for rotation.

10. The structure as claimed in claim 1 further including a base to which said lower panel is mounted for rotation.

* * * * *